US007708624B2

(12) United States Patent
Ebert

(10) Patent No.: US 7,708,624 B2
(45) Date of Patent: May 4, 2010

(54) CLIP MACHINE COMPRISING A CLOSURE LEVER AND A PROCESS FOR THE PRODUCTION OF A CLOSURE LEVER

(75) Inventor: Detlef Ebert, Bad Nauheim (DE)

(73) Assignee: Poly-Clip System GmbH & Co. KG (DE)

( * ) Notice: Subject to any disclaimer, the term of this patent is extended or adjusted under 35 U.S.C. 154(b) by 962 days.

(21) Appl. No.: 11/382,946

(22) Filed: May 12, 2006

(65) Prior Publication Data

US 2006/0276118 A1 Dec. 7, 2006

(30) Foreign Application Priority Data

Jun. 1, 2005 (DE) ..... 10 2005 025 173

(51) Int. Cl.
*A22C 11/12* (2006.01)

(52) U.S. Cl. ..... 452/48

(58) Field of Classification Search ..... 452/30–35, 452/37–39, 46–48, 51
See application file for complete search history.

(56) References Cited

U.S. PATENT DOCUMENTS 4,916,810 A * 4/1990 Yeomans ..... 29/863
5,197,186 A * 3/1993 Strong et al. ..... 29/863
6,101,785 A 8/2000 Bienert et al.
6,182,734 B1 2/2001 Ebert et al.
6,298,635 B1 10/2001 Bienert et al.

FOREIGN PATENT DOCUMENTS

| | | | |
|---|---|---|---|
| DE | 196 12 563 | A1 | 10/1997 |
| DE | 197 38 298 | C1 | 4/1999 |
| DE | 198 50 268 | A1 | 5/2000 |
| DE | 198 34 772 | C2 | 10/2002 |
| EP | 1 508 429 | A1 | 2/2005 |
| GB | 1 563 372 | | 3/1980 |
| WO | 2005/021249 | A1 | 3/2005 |

OTHER PUBLICATIONS

EP 06 01 0920 Search Report.

* cited by examiner

*Primary Examiner*—Thomas Price
(74) *Attorney, Agent, or Firm*—Hahn Loeser & Parks LLP; Michael H. Minns

(57) ABSTRACT

The invention concerns a clip machine comprising at least one closure lever which has a bearing element defining a pivot axis, a receiving element for at least one first closure tool and a force application element for connection to a drive element, wherein the closure lever is mounted pivotably between an open position and a closed position, in which closed position the first closure tool can be brought into engagement with a second closure tool to close a clip. In that respect the closure lever is produced at least partially from a fiber-reinforced plastic composite (FRPC).

11 Claims, 4 Drawing Sheets

CLIP MACHINE COMPRISING A CLOSURE LEVER AND A PROCESS FOR THE PRODUCTION OF A CLOSURE LEVER

This patent application claims priority to German patent application DE 10 2005 025 173.0-27, filed Jun. 1, 2005, hereby incorporated by reference.

TECHNICAL FIELD

The present invention relates to a clip machine, and in particular to a clip machine comprising at least one closure lever which has a bearing element defining a pivot axis, a receiving element for a first closure tool and a force application element for connection to a drive element, wherein the closure lever is mounted pivotably between an open position and a closed position, in which closed position the first closure tool can be brought into engagement with a second closure tool to close a clip. The invention further concerns a process for the production of such a clip lever as well as the use of such a clip lever in a clip machine for portioning sausages.

BACKGROUND OF THE INVENTION

Clip machines of the specified kind are used typically for portioning and closing sausages with a liquid to a firm pasty or even granular content. In that operation firstly the filling material is introduced into a tubular case (skin) and thereafter divided up into portions in a first working cycle by means of displacement elements. For that purpose the displacement elements constrict the tubular case in the radial direction and displace the filling material which is in the constriction region in the axial direction—with respect to the axis of the tubular case. A tubular plaited end portion is thus formed in the constriction region. In the next working cycle one or optionally two closure elements (clips) are applied to the tubular plaited end portion formed in that way, by means of two (or four respectively) closure tools which are moved towards each other, and the closure elements are closed around the plaited end portion. The closure tools respectively include in paired relationship a male die and a female die, between which the clip is shaped around the sausage during the closure operation. In the case of two clips which are closed around the plaited end portion in mutually juxtaposed relationship (dual clip arrangement) the plaited end portion can be severed therebetween by means of a blade in order to separate the sausages. Thereafter the displacement elements, the closure tools and the blade are moved back into their starting or open position. A working cycle is thus concluded. The description hereinafter relates to the simple arrangement of a pair of closure tools. It can however be readily applied to a dual clip arrangement.

At least one of the closure tools (male die and/or female die) is mounted to the closure lever described in the opening part of this specification and effects thereby during the closure process a pivotal movement which is substantially radial—with respect to the axis of the tube—around the pivot axis. At the same time and/or subsequently to the pivotal movement effected by the closure lever with closure tool from the open position thereof into the closed position thereof, the second closure tool is also brought into engagement with the first closure tool to close the clip or clips, in a pivotal movement or a linear movement or a combination of both forms of movement.

In such clip machines, there is generally provided a cam drive which takes off the movement of the closure lever from a cam disk by means of a cam roller. The drive element typically provided is a lever arrangement which transmits that movement to the closure lever. As an alternative or in addition to the cam drive the assembly may also have a linear fluid drive, typically a pneumatic drive.

In that case very high forces (up to 15 kN) are applied to the closure lever or levers by way of the closure tools. On the one hand that results in a production of noise which is unpleasant to the operating personnel while on the other hand it means that the closure lever must be of sufficiently great dimensions for it to withstand the loading. The latter in turn results in the closure lever being of a great weight and thus results in a high mass moment of inertia. As the motor drive including all drive elements (cam disk, cam roller and lever arrangement) cannot be designed to be of just any size that may be desired, the operating speed of the clip machine also cannot be readily increased.

SUMMARY OF THE INVENTION

The object of the present invention is to improve a machine of the kind set forth in the opening part of this specification in such a way that the efficiency of the clip machine can be increased without the drive being of a more powerful design configuration.

The closure levers were produced in known manner from cast aluminum. Besides the above-indicated disadvantages that also had the consequence that the bearing element, the receiving element and the force application element as well as other functional elements such as cams or running surfaces and mounting points can only be produced with the necessary precision on the casting by post-machining. In comparison the closure lever of fiber-reinforced plastic composite (FRPC) is produced in accordance with the process of the invention in one piece completely ready for use. The necessary precision is afforded by the prefabricated casting mold in which the bearing element, the receiving element, the force application element and optionally further functional elements are so laid that the pivot axis, the force application point, the receiving means for the first closure tool and the like are oriented relative to each other within the allowable tolerance, without post-machining.

The considerably lower specific density of the fiber-reinforced plastic composite, particularly when using a carbon fiber-reinforced plastic (CFRP) means that the mass moment of inertia of the closure lever can be reduced by about 30% at least while retaining and in part even when improving the mechanical load-bearing capability. This means that all drive elements are smaller and lighter in dimension to a corresponding degree and the costs of the overall clip machine can be reduced or the working speed of the clip machine can be increased with the dimensioning of the drive elements remaining the same. The use of a FRPC material, because of different resonance properties, also means that the abrupt closure movement of the closure tools experiences an acoustic damping effect, whereby the closure operation represents only an insignificant acoustic loading for the operating personnel. Furthermore the use of an FRPC material and in particular the use of CFRP is advantageously found to be foodstuffs-compatible, sterilizable, temperature-resistant, chemical-resistant (in particular resistant to cleaning agents) and high pressure-resistant. In comparison with the aluminum castings which as is known were used at that location, the surface of the closure lever according to the invention of FRPC material is per se smooth. That makes it possible to save on a further post-machining operation without disregarding the hygiene conditions which are to be observed in the area of foodstuffs processing.

BRIEF DESCRIPTION OF THE DRAWINGS

Further features and advantages of the clip machine according to the invention are set forth in the appended claims. They are described hereinafter with reference to the accompanying drawings in the following description of an embodiment by way of example. In the drawings:

DETAILED DESCRIPTION OF THE DRAWINGS

Figure 1:
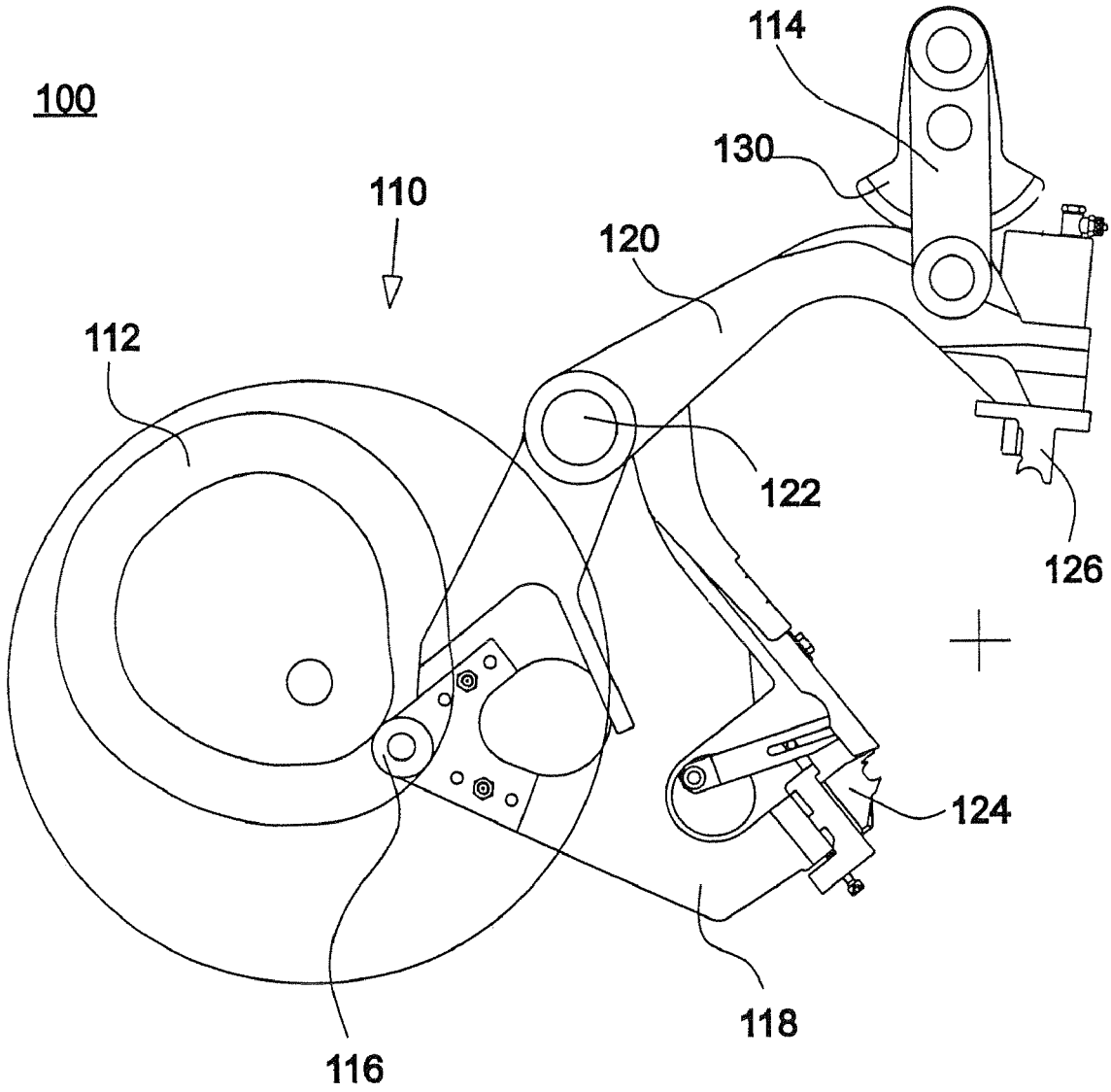
FIG. 1 shows a diagrammatic side view of the moved elements of an embodiment of the clip machine according to the invention.

The embodiment shown in FIG. 1 of the clip machine 100 according to the invention has a clip machine drive 110 with a cam disk 112, from which the movement is taken for a lower closure lever 118 by means of a cam roller 116. In addition the clip machine has a further clip machine drive with a crank 130, from which the movement for an upper closure lever 120 is taken by means of a lever arm 114. In the illustrated embodiment, the two closure levers 118, 120 are mounted pivotably about the same pivot axis 122. At its end remote from the pivot axis 122 the lower clip lever 118 carries a first closure tool 124 which is a female die in the illustrated embodiment. At the same spacing relative to the pivot axis 122 the upper clip lever 120, at its end opposite to the pivot axis 122, carries a second closure tool 126 which is here a male die.

The lower closure lever 118 pivots upwardly about the common pivot axis 122, driven by way of a lower elbow lever arrangement as a drive element, when the elbow lever pivot of the lower elbow lever is straightened by a force applied by way of a coupling rod. In a corresponding manner but in time-displaced relationship the upper clip lever 120 pivots downwardly about the common pivot axis 122, driven by way of an upper elbow lever arrangement as a drive element, when the elbow lever pivot of the upper elbow lever arrangement is straightened by a force applied by way of a coupling rod. That causes the female die 124 and the male die 126 to be moved towards each other in order in the closed position thereof to be able to close a clip around the previously constricted tubular case (not shown). By virtue of the phase-displaced cams for the upper clip lever drive and the lower clip lever drive on the cam disk 112, the lower closure lever 118 is already in its upper closed position and remains there for a short moment while the upper closure lever 120 continues to move in a direction towards the lower clip lever. In that situation a clip introduced into the female die is firstly severed from a following line of clips and is gripped between the female die 124 and the tubular plaited end portion (not shown) and held in that fashion. When the upper clip lever 120 also approaches its (lower) closed position, the clip is closed around the constricted tubular case. When the clip lever 120 has moved into its closed position a pulse triggers actuation of the piston-cylinder arrangement which—in the case of the dual clip arrangement present here—drives a blade in order to sever the tubular plaited end portion between the two closed clips. After that the upper and the lower closure levers 118, 120 pivot back into their open positions.

By virtue of the high force which is required to close the clip and the high moment which results therefrom and which acts on both closure levers 118, 120, both closure levers 118, 120 must be of very great strength. On the other hand, both levers must perform a sufficiently large pivotal movement so that even sausages of large size can be conveyed through between the closure tools 124, 126 during the filling operation in a direction of movement perpendicular to the plane shown in FIG. 1. The lower closure lever 118 according to the invention enjoys sufficient strength while nonetheless being of comparatively low weight and thus involving a low mass moment of inertia about the pivot axis 122, if the lower closure lever 118 is at least partially made from a fiber-reinforced plastic composite. Depending on whether the arrangement has one or two closure levers and depending on how the pivotal movement is distributed to the closure lever or levers, it may be sufficient for one closure lever to be partially made from an FRPC material, or also both.

Figure 2:
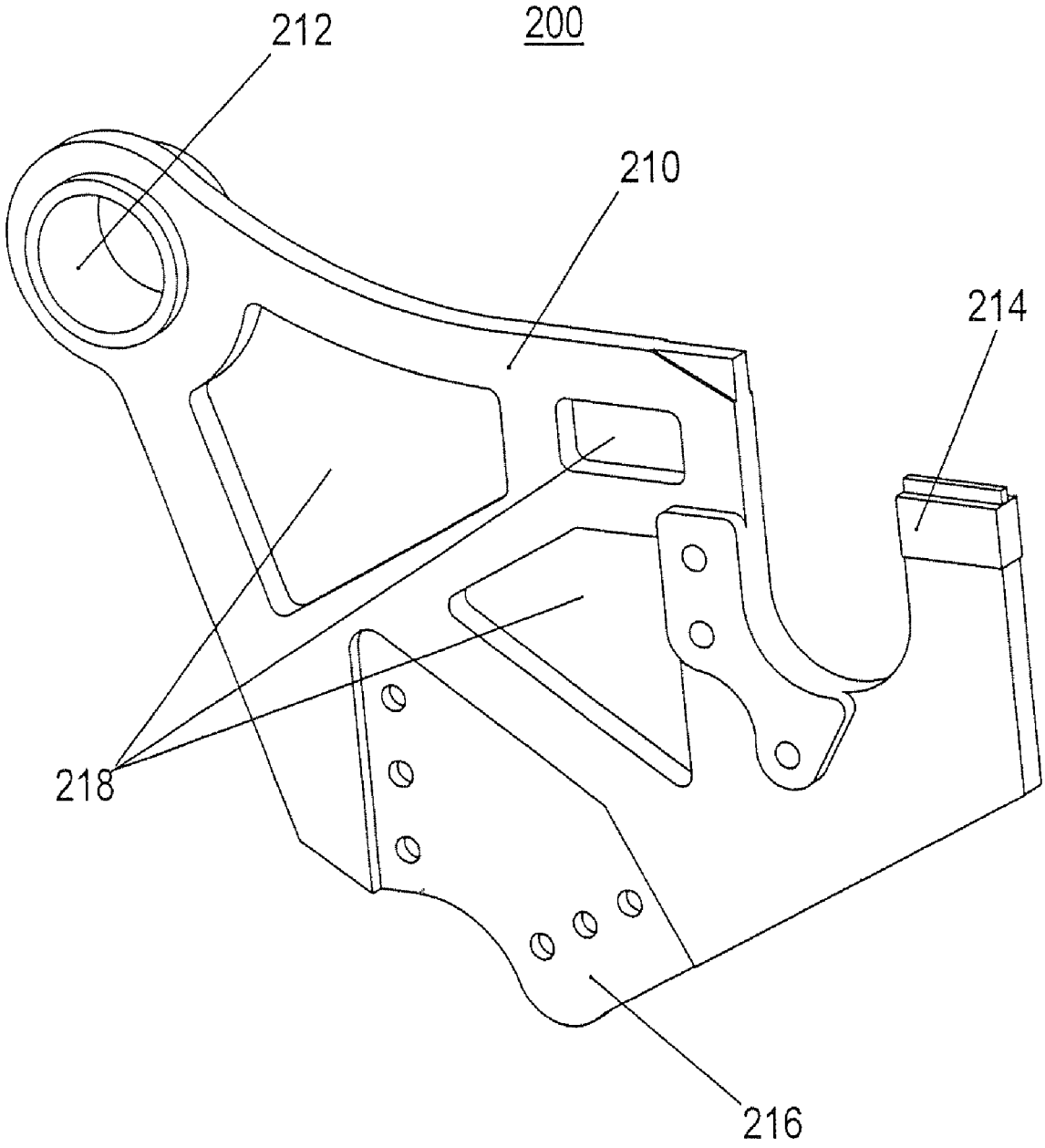
FIG. 2 shows a side view of an embodiment of a closure lever in the clip machine.

FIG. 2 is a side view of an embodiment of such a lower closure lever 200. It has a main body 210 which extends substantially in the plane of the illustration. A bearing element 212 is let into that main body and it includes a first metallic bearing receiving means. That bearing receiving means has rotation-preventing means for example in the form of notches or projections, which prevent the bearing element 212 from turning in the FRPC material. Also let into the main body 210 are a receiving element 214 for positioning and holding the first closure tool or tools, and a force application element 216 for connection to the drive element. Both the receiving element 214 and also the force application element 216 are preferably let into the main body 210, in the form of a metallic insert. In addition the main body has openings 218, by which the weight of the closure lever 200 is reduced without however dropping below the predetermined limit in respect of stability of the closure lever. Instead of or in addition to the apertures shown in FIG. 2, the openings 218, in a similar or different arrangement, may also include pockets which are not right through and which transmit the flow of force in a possibly different fashion, but also with the proviso of adequate stability.

Figure 3:
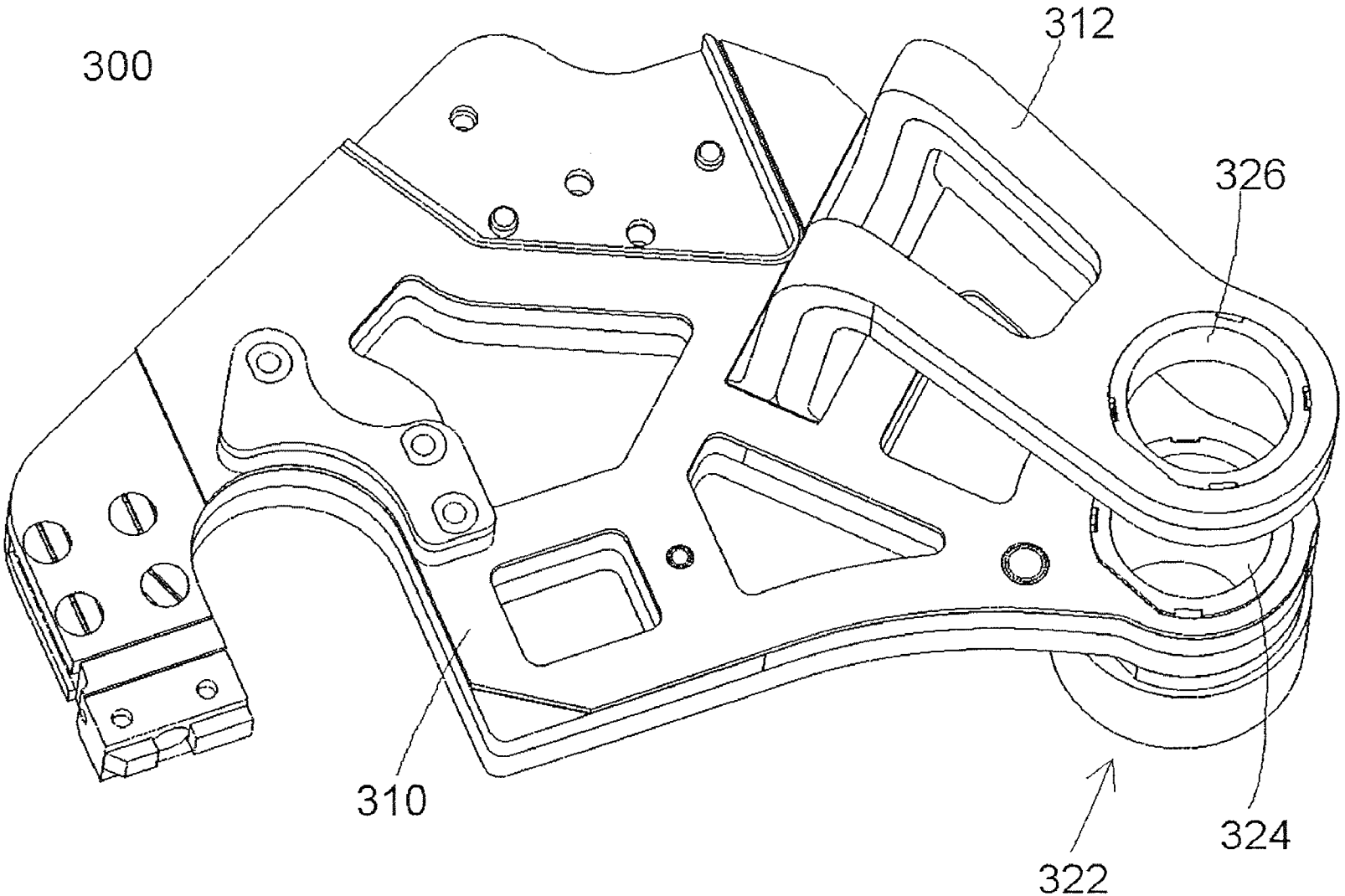
FIG. 3 shows a perspective view of an embodiment of the closure lever according to the invention.

The embodiment of the lower closure lever shown in FIG. 3 shows as a perspective view that, besides the main body 310, there is also a cranked cantilever arm 312 which is connected at one end 313 to the main body 310. The cranked cantilever arm 312 thus projects out of the plane defined by the main body 310. In this embodiment the mounting element 322 comprises a metallic bearing receiving means 324 which is let into the main body 310 from one side so that the first bearing receiving means 324 projects out of the plane of the main body 310 on the side in opposite relationship to the cranked cantilever arm 312. In addition the bearing element 322 comprises a second metallic bearing receiving means 326 which is let into the cranked arm 312 in coaxial relationship with the first metallic bearing receiving means 324. Those bearing receiving means provide that the bearing support effect can be implemented over such a long axial portion that the closure lever can withstand relatively high flexural moments in the axial direction.

In the process according to the invention for the production of such a clip lever, for example in the preform RTM production process, the operation of letting the insert portions into the lever is effected by laying the bearing element 212, 312, the receiving element 214, 314 and the force application element 216, 316 in a molding tool in which moreover the main body 210, 310 and possibly the cantilever arm 312 is built up in layer-wise fashion from layers of preformed fiber mats, of a carbon fiber cloth. The molding tool is then closed and a liquid plastic (for example epoxy resin) is injected under high pressure into the mold until the mold is filled. After the plastic sets the mold can be opened and the finished closure lever 200, 300 can be removed. The insert portions are involved in a positively locking join to the stabilising fiber mats, by means of the hardened plastic. The way in which the stability of the positively locking join can be still further increased will be described in greater detail with reference to the embodiment in the exploded view in FIG. 4.

Figure 4:
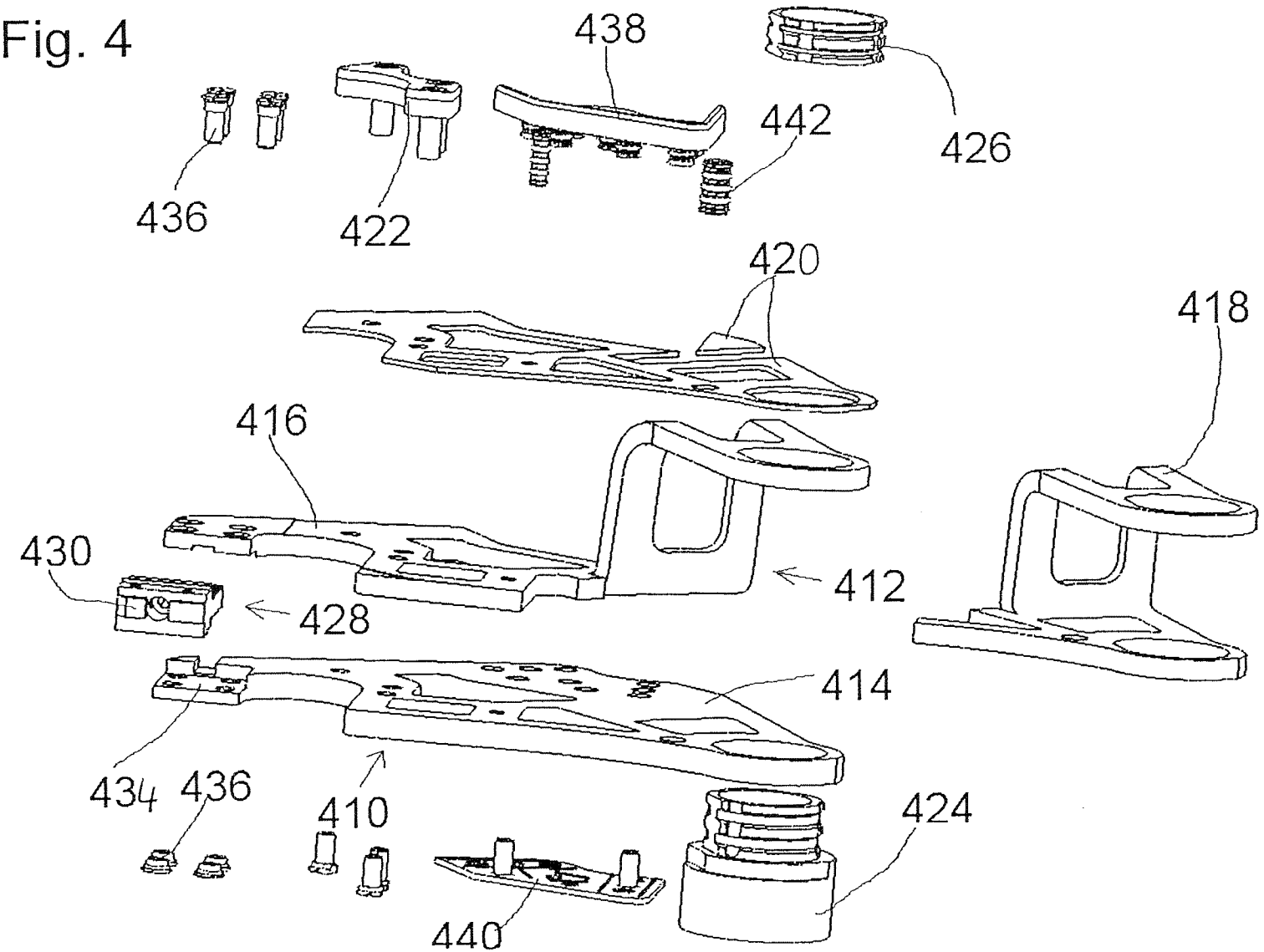
FIG. 4 shows an exploded view of the individual components of the clip lever shown in FIG. 3.

FIG. 4 shows all elements of the closure lever according to the invention. Firstly the closure lever elements which are built up in layer-wise fashion from fiber mats will be described, namely the main body 410 and the cranked cantilever arm 412 connected to the main body at one end. Both the main body and also the cantilever arm of the closure lever are composed layer-wise of a lower portion 414 of preshaped fiber mats, an upper portion 416 of preformed fiber mats and a central portion 418 also of preformed fiber mats. In that case the main body 410 is made up on the one hand in layer-wise fashion from the lower portion 414 and a lower part of the upper portion 416 and on the other hand it is made up layer-wise from the lower portion 414 and a lower part of the central portion 418. The cranked cantilever arm 412 which at one end is connected to the main body 410 and at its other end projects out of the plane of the main body 410 is in turn built up layer-wise from an upper part of the central portion 418 and an upper part of the upper portion 416. That sandwich form provides that the main body 410 and the cantilever arm 412 are joined throughout by virtue of interconnected fiber mats, which imparts a high level of stability to the closure lever. Stability is further increased by a cover layer 420 which is formed from preformed fiber mats and which is applied to the respective lower parts of the upper portion 416 and the central portion 418 on the side in opposite relationship to the lower portion 414. That compensates for the weakening effect caused by the main body 410 being divided into two in the upper layers thereof.

In addition further functional elements such as for example a spacer plate 422 of FRPC is laminated on the top side of the main body 410. Such functional elements can be laminated in position at any location, depending on the respective structural demands on the closure lever. In a corresponding manner, it is also possible to provide openings, apertures, pockets or the like by suitably cutting the preformed fiber mats.

As in FIG. 3 the bearing element comprises the metallic bearing receiving means 424 in the main body 410, which projects out of the plane thereof on the side in opposite relationship to the cranked cantilever arm 412, and the second metallic bearing receiving means 426 which is let into the cranked arm 412 in coaxial relationship with the first metallic bearing receiving means 424. Both bearing receiving means 424, 426 have both axial and also radial means for preventing rotation and pulling displacement respectively. They can be provided in the form of notches, grooves, peripherally extending channels or corresponding projections, into which the liquid plastic penetrates in the operation of filling the injection molding mold and thus involve a positively locking join to the metal part.

At its end of the closure lever in opposite relationship to the bearing element, the metallic receiving element 428 is let into the main body 410 of the closure lever. The receiving element 428 has a receiving portion 430 for the first closure tool (not shown here), which projects out of the FRPC material, and an anchorage portion 432 which is let in position substantially in the plane of the main body 410 between the lower portion 414 and the upper portion 416. Provided for that purpose is a corresponding opening 434 in the lower portion 414 and/or in the upper portion 416. In order further to improve the fixing of the receiving element 428 it can be anchored transversely with respect to the plane of the main body 410 by the anchorage portion 432 with fixing means 436 which for example can be in the form of bolts or screws.

In addition the force application element in the form of a metallic insert portion 438 is also let into a corresponding opening or pocket in the upper portion 416 and the cover layer 420. For the purposes of stabilisation and mechanically securing the metallic insert portion 438 disposed on the opposite side of the main body 410 is a corresponding counterlocking plate 440 which is connected to the insert portion 438 through the lower portion 414 of the main body 410 with fixing means 442 (for example by screwing) and thus involves a positively locking connection to the FRPC main body 410.

All fitting means, bores, screwthreads, cams and the like can already be prefabricated in all functional elements like the bearing element, the receiving element and the force application element. The fact that the functional elements are fitted into the molding tool in accurately fitting relationship means that the dimensional tolerances are observed between the individual functional elements and thus between the measurement points, within the prescribed tolerances.

The invention claimed is:

1. A clip machine comprising:

at least one closure lever including a bearing element defining a pivot axis, a receiving element for at least one first closure tool and a force application element for connection to a drive element wherein the closure lever is mounted pivotably between an open position and a closed position, in which closed position the first closure tool can be brought into engagement with a second closure tool to close a clip, wherein the closure lever is produced at least partially from a fiber-reinforced plastic composite (FRPC), and wherein the closure lever has a substantially flat main body of a fiber-reinforced plastic composite, and wherein the bearing element has at least one first metallic bearing receiving means which is let into the main body of the closure lever.

2. The clip machine of claim 1, wherein the closure lever has a cranked cantilever arm comprising the fiber-reinforced plastic composite, which is connected at one end to the main body.

3. The clip machine of claim 2, wherein the main body and the cantilever arm of the closure lever are composed at least of a lower portion formed from preformed fiber mats and an upper portion formed from preformed fiber mats, wherein the main body on the one hand is made up layer-wise from the lower portion and the upper portion and the cantilever arm is formed from a part of the upper portion, which part projects out of the plane of the main body.

4. The clip machine of claim 3 further comprising a central portion formed from preformed fiber mats, wherein the main body on the one hand is made up layer-wise from the lower portion and the central portion and the cantilever arm is made up layer-wise from the part of the upper portion, which part projects out of the plane of the main body, and a part of the central portion, which part projects out of the plane of the main body.

5. The clip machine of claim 4 further comprising a cover layer which is formed from preformed fiber mats and which is applied on the side of the upper portion and the central portion, which side is in opposite relationship to the lower portion.

6. The clip machine of claim 3, wherein the receiving element comprises metal and has a receiving portion for the first closure tool and an anchoring portion which is let in position substantially in the plane of the main body between the lower portion and the upper portion.

7. The clip machine of claim 6, wherein the anchorage portion is anchored transversely with respect to the plane of the main body by fixing means.

8. The clip machine of claim 2, wherein the main body and/or the cantilever arm have openings.

9. The clip machine of claim 1, wherein the force application element is let into the main body in the form of a metallic insert portion.

10. The clip machine of claim 1, wherein the bearing element has at least one second metallic bearing receiving means which is let into the cranked cantilever arm in coaxial relationship with the first metallic bearing receiving means.

11. The clip machine of claim 1, wherein the fiber-reinforced plastic composite is a carbon fiber-reinforced plastic (CFRP).

* * * * *